US008299698B2

(12) United States Patent
Liu et al.

(10) Patent No.: US 8,299,698 B2
(45) Date of Patent: Oct. 30, 2012

(54) FIELD EMISSION DISPLAY

(75) Inventors: Peng Liu, Beijing (CN); Shou-Shan Fan, Beijing (CN); Liang Liu, Beijing (CN); Kai-Li Jiang, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/159,609

(22) Filed: Jun. 14, 2011

(65) Prior Publication Data

US 2011/0241537 A1 Oct. 6, 2011

Related U.S. Application Data

(63) Continuation of application No. 12/317,149, filed on Dec. 19, 2008, now Pat. No. 7,990,042.

(30) Foreign Application Priority Data

Mar. 19, 2008 (CN) ..... 2008 1 0066119

(51) Int. Cl.
*H01J 1/62* (2006.01)

(52) U.S. Cl. ..... 313/495

(58) Field of Classification Search ..... 313/495–497, 313/461; 362/84

See application file for complete search history.

(56) References Cited

U.S. PATENT DOCUMENTS

2006/0061257 A1* 3/2006 Nakamoto ..... 313/496
2007/0029525 A1* 2/2007 Gotoh et al. ..... 252/301.4 F

FOREIGN PATENT DOCUMENTS

TW 200711991 4/2007

* cited by examiner

*Primary Examiner* — Anh Mai
*Assistant Examiner* — Brenitra M Lee
(74) *Attorney, Agent, or Firm* — Altis Law Group, Inc.

(57) ABSTRACT

A field emission device includes a transparent plate, an insulating substrate, one or more grids located on the insulating substrate. Each grid includes a first, second, third and fourth electrode down-leads and a pixel unit. The first, second, third and fourth electrode down-leads are located on the periphery of the grid. The first and the second electrode down-leads are parallel to each other. The third and the fourth electrode down-leads are parallel to each other. The pixel unit includes a phosphor layer, a first electrode, a second electrode and at least one electron emitter. The first electrode and the second electrode are separately located. The first electrode is electrically connected to the first electrode down-lead, and the second electrode is electrically connected to the third electrode down-lead. The phosphor layer is directly located on the corresponding first electrode.

20 Claims, 5 Drawing Sheets

FIELD EMISSION DISPLAY

RELATED APPLICATIONS

This application is a continuation of U.S. patent application Ser. No. 12/317,149, filed on Dec. 19, 2008, entitled, "FIELD EMISSION DISPLAY". This application is related to a commonly-assigned application entitled, "FIELD EMISSION DISPLAY DEVICE", filed on Dec. 19, 2008, U.S. patent application Ser. No. 12/317,146. The disclosures of the above-identified applications are incorporated herein by reference.

BACKGROUND

1. Technical Field

The present invention relates to field emission displays, particularly, to a carbon nanotube based field emission display.

2. Discussion of Related Art

Conventional field electron emission displays include field emission displays (FED) and surface-conduction electron-emitter displays (SED). Field electron emission displays can emit electrons in the principle of a quantum tunnel effect opposite to a thermal excitation effect, which is of great interest from the viewpoints of promoting high brightness and low power consumption.

Referring to FIG. 3, according to the prior art, a field emission display 300 generally includes a transparent substrate 310, an insulating substrate 330, and a number of electron emission units 320, a number of cathode electrodes 328, a number of gate electrodes 324, and a number of spacers 340. The transparent substrate 310 is spaced from the insulating substrate 330 by a number of spacers 340. A conductive layer 316, a phosphor layer 314, and a filter layer 312 are located on the surface of the transparent plate 310 facing the insulating substrate 330. The electron emission units 320, cathode electrodes 328, and gate electrodes 324 are located on the insulating substrate 330. The cathode electrodes 328 and the gate electrodes 324 cross each other to form a plurality of crossover regions. A plurality of insulating layers 326 is arranged corresponding to the crossover regions. Each electron emission unit 320 includes at least one electron emitter 322. The electron emitter 322 is in electrical contact with the cathode electrode 328 and spaced from the gate electrode 324. When receiving a voltage that exceeds a threshold value, the electron emitter 322 emits electron beams towards the gate electrodes 324. When a higher voltage is added on the conductive layer 316 and the cathode electrodes 328, the electron beams emitted from the electron emitters 322 are attracted to the phosphor layer 314. The luminance is adjusted by altering the applied voltage. However, the distance between the gate electrode 324 and the cathode electrode 328 is difficult to control well. As a result, the driving voltage is relatively high, thereby increasing the overall operational cost.

Referring to FIG. 4 and FIG. 5, according to the prior art, a surface-conduction electron-emitter display 100 includes an insulating substrate 130, a number of spacers 140, a transparent substrate 110 spaced from the insulating substrate 130 by a number of spacers 140, and a number of electron emission units 120, a number of row electrodes 134, a number of column electrodes 132 located on the insulating substrate 130. An anode conductive layer 116, a phosphor layer 114, and a filter layer 112 are located on the surface of the transparent plate 110 facing the insulating substrate 130. The row electrodes 134 and column electrodes 132 are parallel to and spaced from each other. Every two adjacent row electrodes 134 and every two adjacent column electrodes 132 form a square 138. The electron-emission units 120 are located on the insulating substrate 130. Each of the electron-emission units 120 is corresponding to one square 138. The electron-emission unit 120 includes, a cathode electrode 125, a gate electrode 126, and an emitter 127 located on the cathode electrode 125 and the gate electrode 126. An electron-emission gap 124 is formed in the middle of the electron emitter 127. The cathode electrode 125 and gate electrode 126 are spaced from each other. The cathode electrode 125 is electrically connected to the corresponding column electrodes 132 and the gate electrode 126 is electrically connected to the corresponding row electrodes 134. When a voltage is applied between the cathode electrode 125 and the gate electrode 126, an electron current is formed across the electron-emission gap 124. When a higher voltage is applied on the anode conductive layer 116, a portion of the electrons of the electron current in the electron-emission gap 124 is attracted to the phosphor layer 114. The luminance is adjusted by altering the applied voltage. However, because the electron current includes the emission current and conduction current, and only few electrons can escape to the phosphor layer 114, and the efficiency of the surface-conduction electron-emitter display 100 is relatively lower than 3%.

What is needed, therefore, is to provide a highly efficient field emission display with a simple structure.

BRIEF DESCRIPTION OF THE DRAWINGS

Many aspects of the present field emission display can be better understood with references to the following drawings. The components in the drawings are not necessarily drawn to scale, the emphasis instead being placed upon clearly illustrating the principles of the present field emission display.

Figure 1:
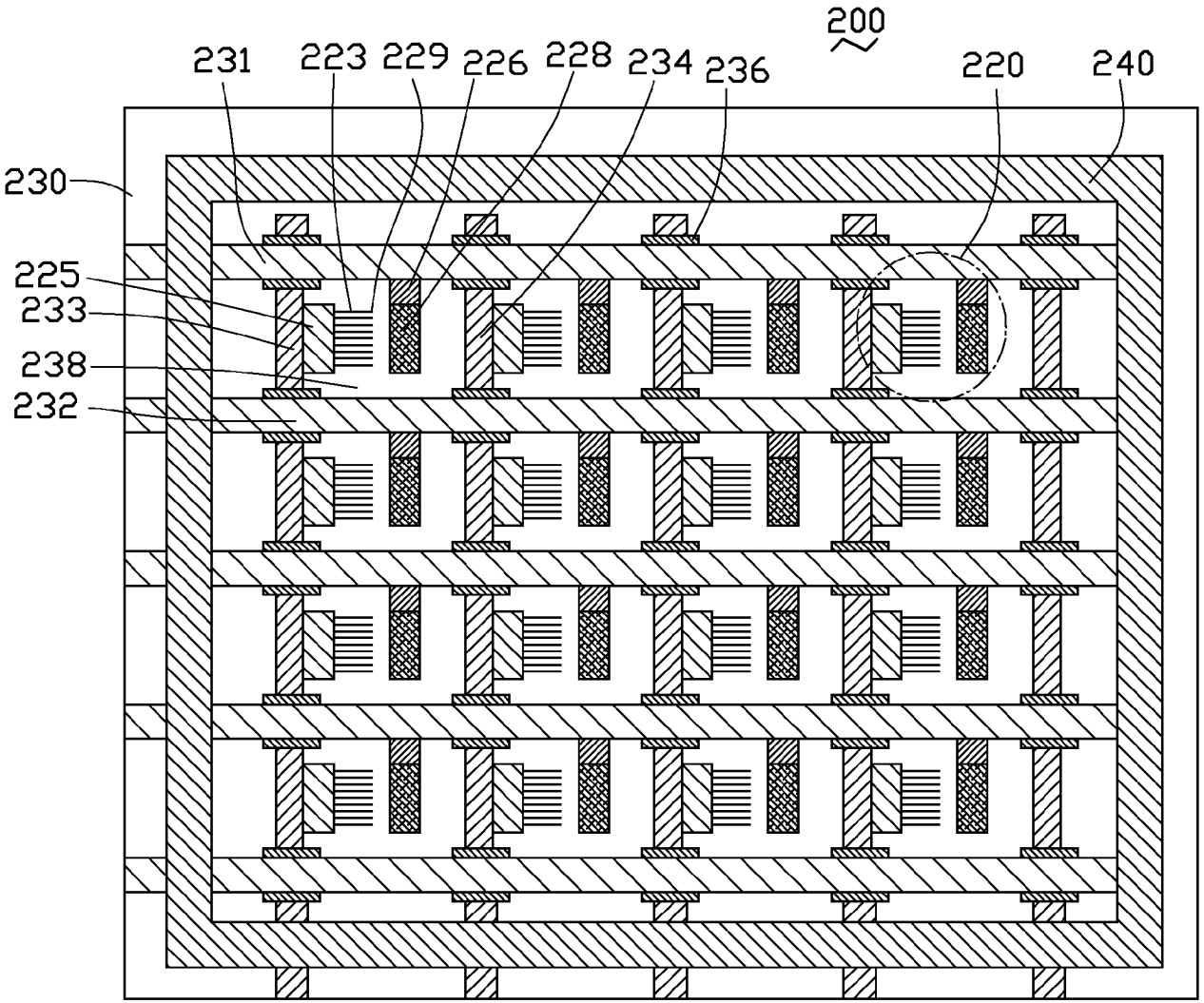
FIG. 1 is a schematic top view of a field emission display, in accordance with an exemplary embodiment.

Corresponding reference characters indicate corresponding parts throughout the several views. The exemplifications set out herein illustrate at least one embodiment of the present field emission displays, in at least one form, and such exemplifications are not to be construed as limiting the scope of the invention in any manner.

DETAILED DESCRIPTION OF EXEMPLARY EMBODIMENTS

References will now be made to the drawings to describe, in detail, embodiments of the present field emission display.

Figure 2:
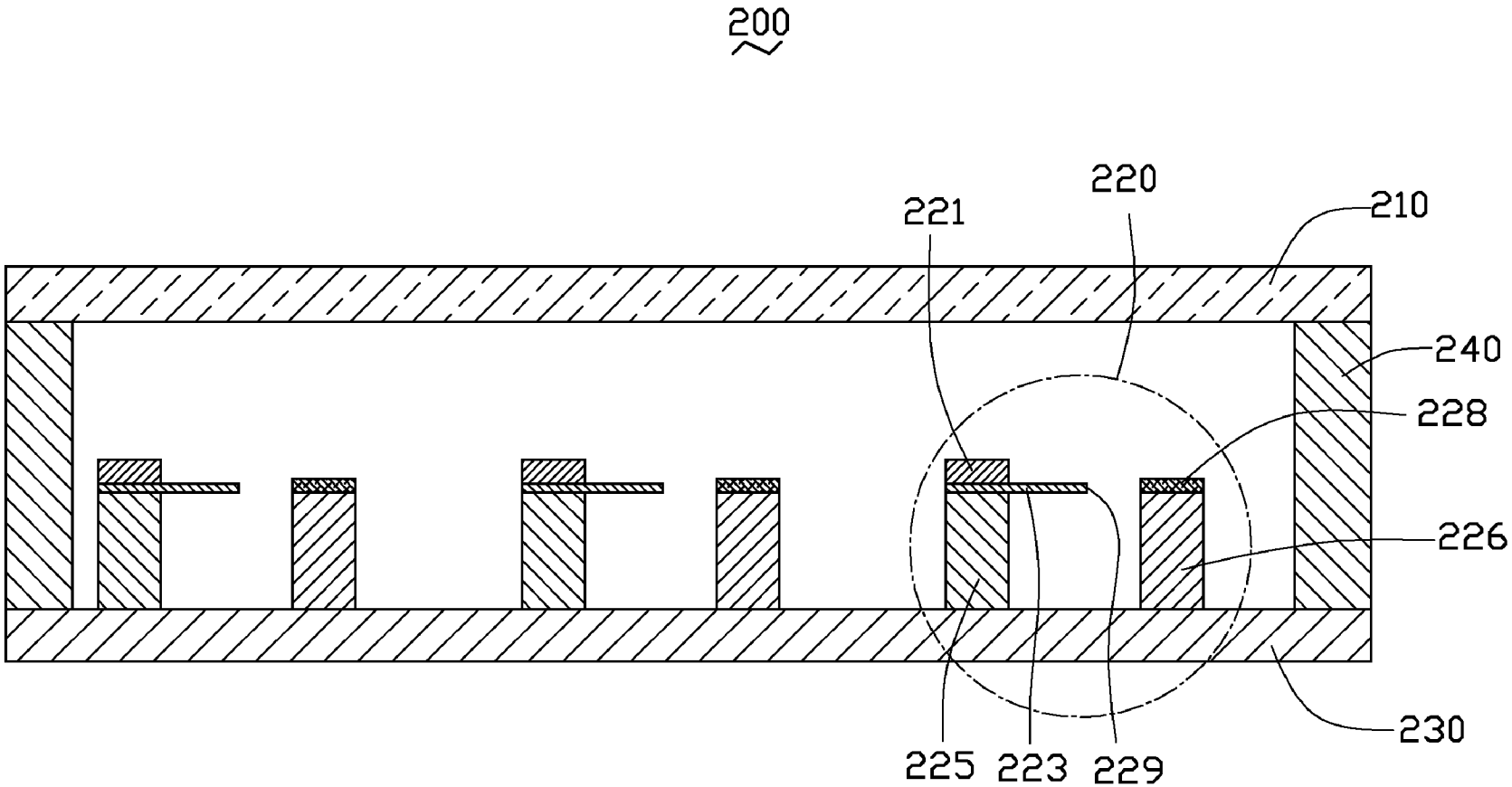
FIG. 2 is a schematic side view of the electron emission display of FIG. 1.
Figure 3:
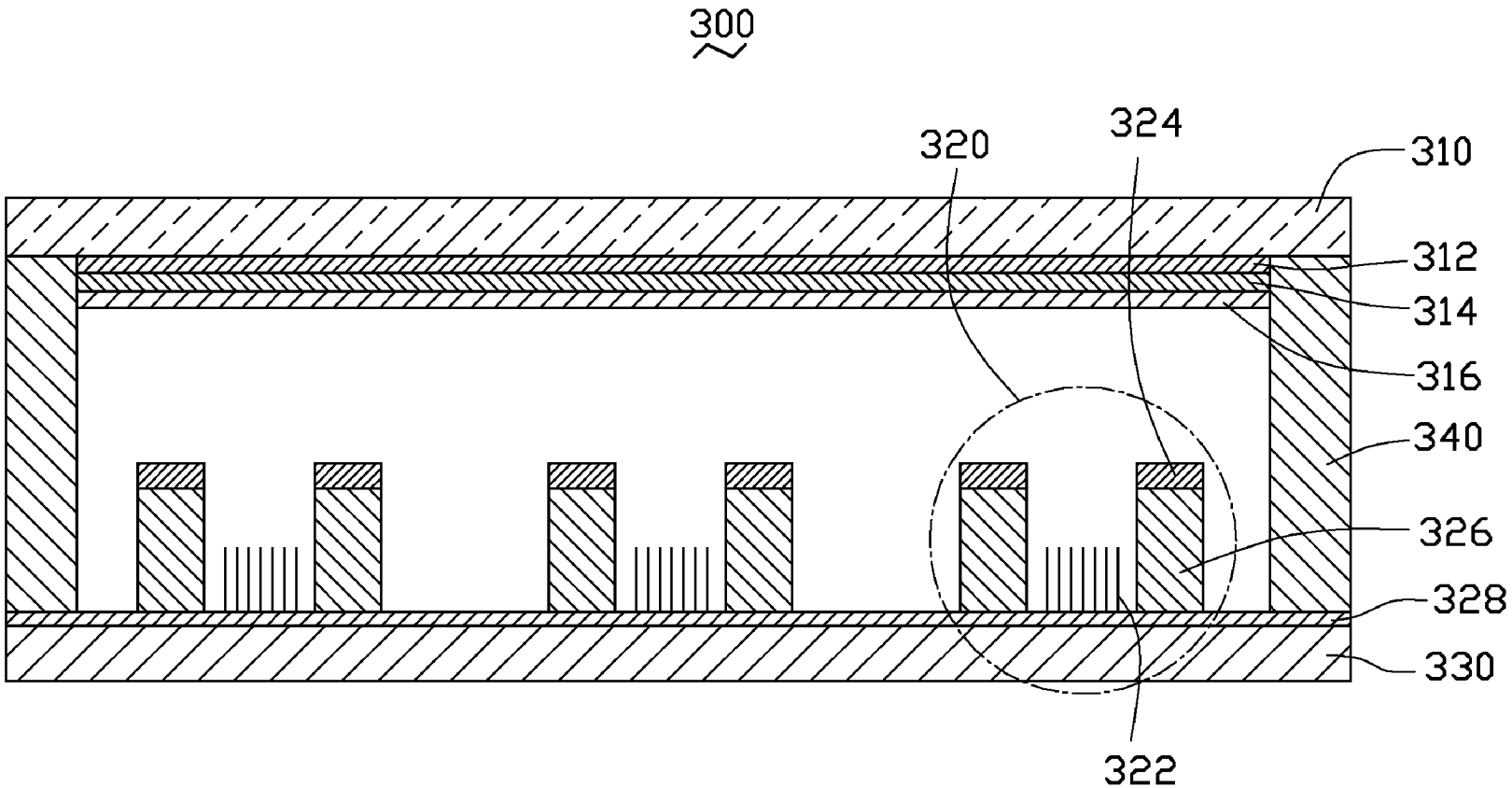
FIG. 3 (RELATED ART)
FIG. 3 is a schematic side view of a conventional field emission display according to the prior art.

Referring to FIG. 1 and FIG. 2, the field emission display 200 includes a transparent plate 210, an insulating substrate 230 opposite to the transparent plate 210, a number of supporters 240, and one or more grids 238 located on the insulating substrate 230.

The transparent plate 210 can be made of transparent materials, such as glass. The thickness of the transparent plate 210 is determined according to user-specific needs.

The insulating substrate 230 can be made of glass, ceramics, resin, or quartz. In this embodiment, the insulating substrate 230 is made of glass. The thickness of the insulating substrate 230 is determined according to user-specific needs. In this embodiment, the thickness of the insulating substrate 230 is thicker than 1 millimeter (mm), and the length of the insulating substrate 230 is longer than 1 centimeter.

Each grid 238 includes a first electrode down-lead 231, a second electrode down-lead 232, a third electrode down-lead 233, a fourth electrode down-lead 234, and a pixel unit 220. The first, second, third and fourth electrode down-leads 231, 232, 233, 234 are located on the periphery of the grid 238. The first electrode down-lead 231 and the second electrode down-lead 232 are parallel to each other. The third electrode down-lead 233 and the fourth electrode down-lead 234 are parallel to each other. The first electrode down-lead 231 and the second electrode down-lead 232 cross the third electrode down-lead 233 and the fourth electrode down-lead 234. A suitable orientation of the first, second, third, and fourth electrode down-leads 231, 232, 233, 234 is that they be set at an angle with respect to each other. The angle approximately ranges from about 10 degrees to about 90 degrees between the first and third down leads 231, 233. In the present embodiment, the angle is 90 degrees. In addition, a distance between the first electrode down-lead 231 and the second electrode down-lead 232 ranges from about 50 microns (μm) to about 10 mm. A distance between the third electrode down-lead 233 and the fourth electrode down-lead 234 ranges from about 50 μm to about 10 mm. It is to be understood that the electrode down-leads of one grid can be different electrode down-leads for an adjacent gird. For example, the same electrode down-lead can be the first for one grid and the second for an adjacent grid.

Furthermore, the field emission display 200 of the exemplary embodiment can further include a plurality of insulators 236 sandwiched between the first or second electrode down-leads 231, 232 and the third or fourth electrode down-leads 233, 234 to avoid short-circuiting. That is, the insulators 236 are disposed at every intersection of any two electrode down-leads 231, 232, 233, 234 for providing electrical insulation between the electrode down-leads 231, 232 and the electrode down-leads 233, 234. In the present embodiment, the insulator 236 can be a dielectric insulator.

In the present embodiment, the electrode down-leads 231, 232, 233, 234 are made of conductive material, for example, metal. In practice, the electrode down-leads 231, 232, 233, 234 are formed by applying conductive slurry on the insulating substrate 230 using printing process, e.g. silk screen printing process. The conductive slurry is composed of metal powder, glass powder, and binder. For example, the metal powder can be silver powder and the binder can be terpineol or ethyl cellulose (EC). Particularly, the conductive slurry includes 50% to 90% (by weight) of the metal powder, 2% to 10% (by weight) of the glass powder, and 10% to 40% (by weight) of the binder. In the present embodiment, each of the electrode down-leads 231, 232, 233, 234 is formed with a width ranging from about 20 μm to about 1 mm and with a thickness ranging from about 10 μm to about 100 μm. However, it is noted that dimensions of each electrode down-lead 231, 232, 233, 234 can vary corresponding to dimensions of each grid 238.

The pixel units 220 are located on the insulating substrate 230. One pixel unit 220 is located in each grid 204. The pixel unit 220 includes a phosphor layer 228, a first electrode 226, a second electrode 225, and at least one electron emitter 223. The first electrode 226 is disposed corresponding to the second electrode 225. The first electrode 226 and second electrode 225 are spaced from each other. In addition, the first electrode 226 is spaced apart from the second electrode 225. The electron emitter 223 is disposed between the first electrode 226 and the second electrode 225. The electron emitter 223 is spaced from or located on the insulating substrate 230. The phosphor layer 228 is located on the first electrode 226.

The first electrode 226 is electrically connected to the first electrode down-lead 231 and the second electrode 225 is electrically connected to the third electrode down-lead 233. One end of the electron emitter 223 is electrically connected to the corresponding second electrode 225, and an opposite end of the electron emitter 223 is spaced from the first electrode 226 by a predetermined distance ranging from about 10 μm to about 1000 μm. The opposite end of the electron emitter 223 serves as an electron emitting tip 229. The electron emitting tip 229 is pointed in the direction of the first electrode 226.

The first electrodes 226 of the pixel units 220 arranged in a row of the grids 238 are electrically connected to the first electrode down-lead 231. In addition, the second electrodes 225 of the pixel units 220 arranged in a column of the grids 238 are electrically connected to the third electrode down-lead 233. In the present embodiment, the first electrode 226 serves as a anode and the second electrode 225 serves as an cathode.

In this embodiment, the first electrodes 226 and second electrodes 225 are strip-shaped planar conductors, a dimension of the first electrodes 226 and second electrodes 225 is determined according to a dimension of the grid 238. The first electrodes 226 and second electrodes 225 are planar conductors. The length of the first electrodes 226 and second electrodes 225 ranges from about 10 μm to about 1 mm. A width of the first electrodes 226 and second electrodes 225 ranges from about 10 μm to about 1 mm. The thickness of the first electrodes 226 and second electrodes 225 ranges from about 1 μm to about 1 mm. In this embodiment, the length of the first electrodes 226 and second electrodes 225 is about 150 μm, the width of the first electrodes 226 and second electrodes 225 is about 50 μm, the thickness of the first electrodes 226 and second electrodes 225 is about 50 μm. In addition, the first electrode 226 and the second electrode 225 of the present embodiment are formed by printing the conductive slurry on the insulating substrate 230. As mentioned above, the conductive slurry forming the first electrode 226 and the second electrode 225 is the same as the electrode down-leads 231, 232, 233, 234.

The phosphor layers 228 can be made of low voltage phosphor or high voltage phosphor and formed by a method of deposition, coating or printing. The thickness of the phosphor layers 228 ranges from about 5 to about 50 μm.

In the present embodiment, the electron emitters 223 of each pixel unit 220 are arranged in an array. The electron emitters 223 are parallel to each other and spaced from each other for a certain distance. The electron emitter 223 includes a conductive structure selected from a group consisting of silicon wires, carbon fiber wires, carbon nanotube wires or carbon nanotubes. One end of electron emitter 223 is electrically connected to the corresponding second electrode 225, the other end of the electron emitter 223 is pointed in the direction of the phosphor layers 228 on the corresponding first electrode 226. The electron emitter 223 is electrically connected to the corresponding second electrode 225 by some means such as a conductive binder. Each electron emitter 223 includes one electron emission tip 229, and the electron emission tip 229 is the end of the electron emitter 223 far away from the second electrode 225. The electron emission tip 229 is pointed in the direction of the corresponding first electrode 226. The length of the electron emitter 223 ranges from about 1 μm to about 1 mm. A space between the electron emission tip 229 and the corresponding first electrode 226 ranges from about 10 microns to about 1 millimeter. A space between every two adjacent electron emitters 223 ranges from about 1 μm to about 100 nm.

The supporters 240 can be made of insulative materials, such as glass, ceramics, resin, or quartz. The thickness of the supporters 240 is thicker than that of the first, second, third and fourth electrode down-leads 231, 232, 233, 234. The supporters 240 can be located on the surface of the insulating substrate 230 according to user-specific needs. In this embodiment, the thickness of the supporters 240 ranges from about 10 μm to about 5 mm, the width of the supporters 240 ranges from about 30 μm to about 10 mm.

Figure 4:
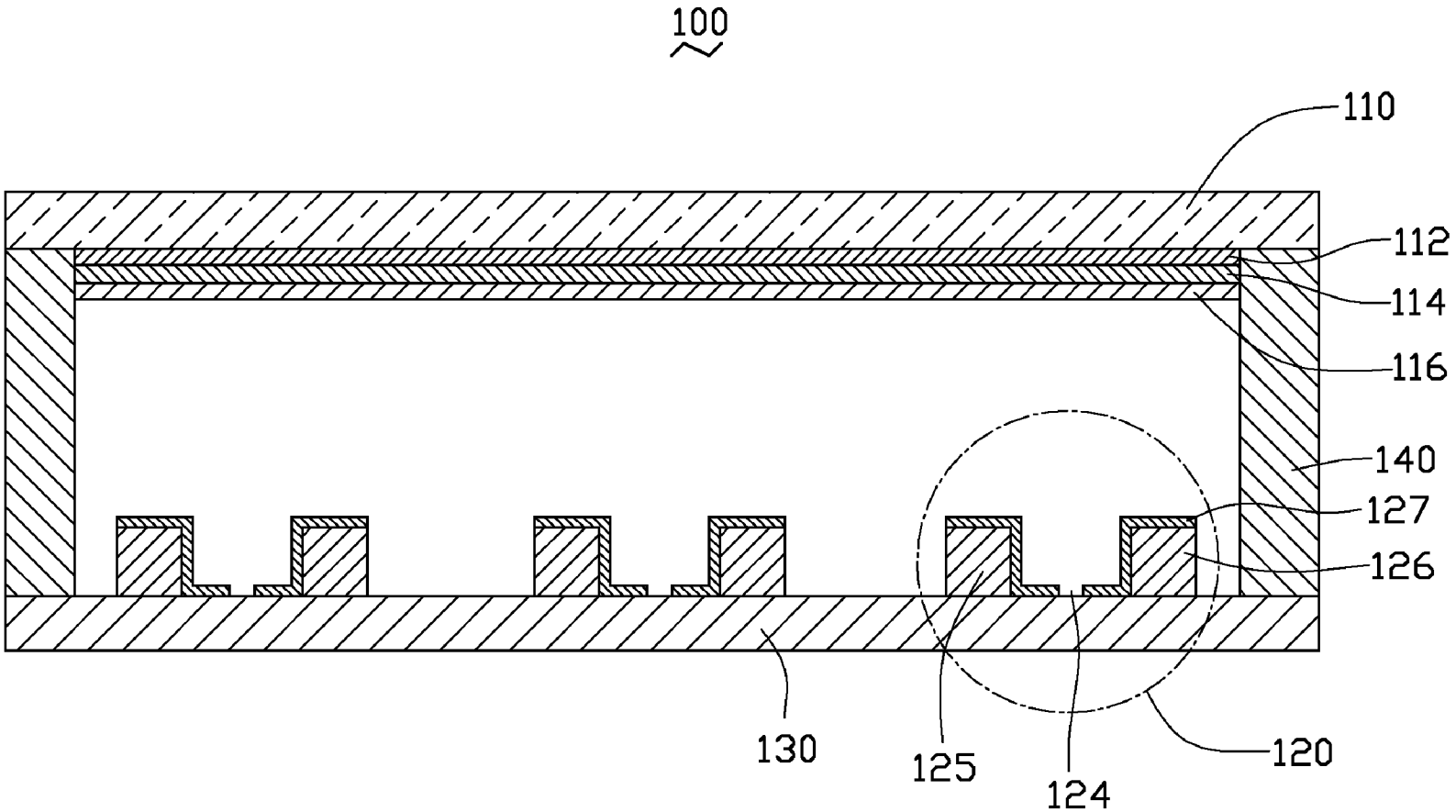
FIG. 4 (RELATED ART)
FIG. 4 is a schematic side view of a conventional surface-conduction electron-emitter display according to the prior art.
Figure 5:
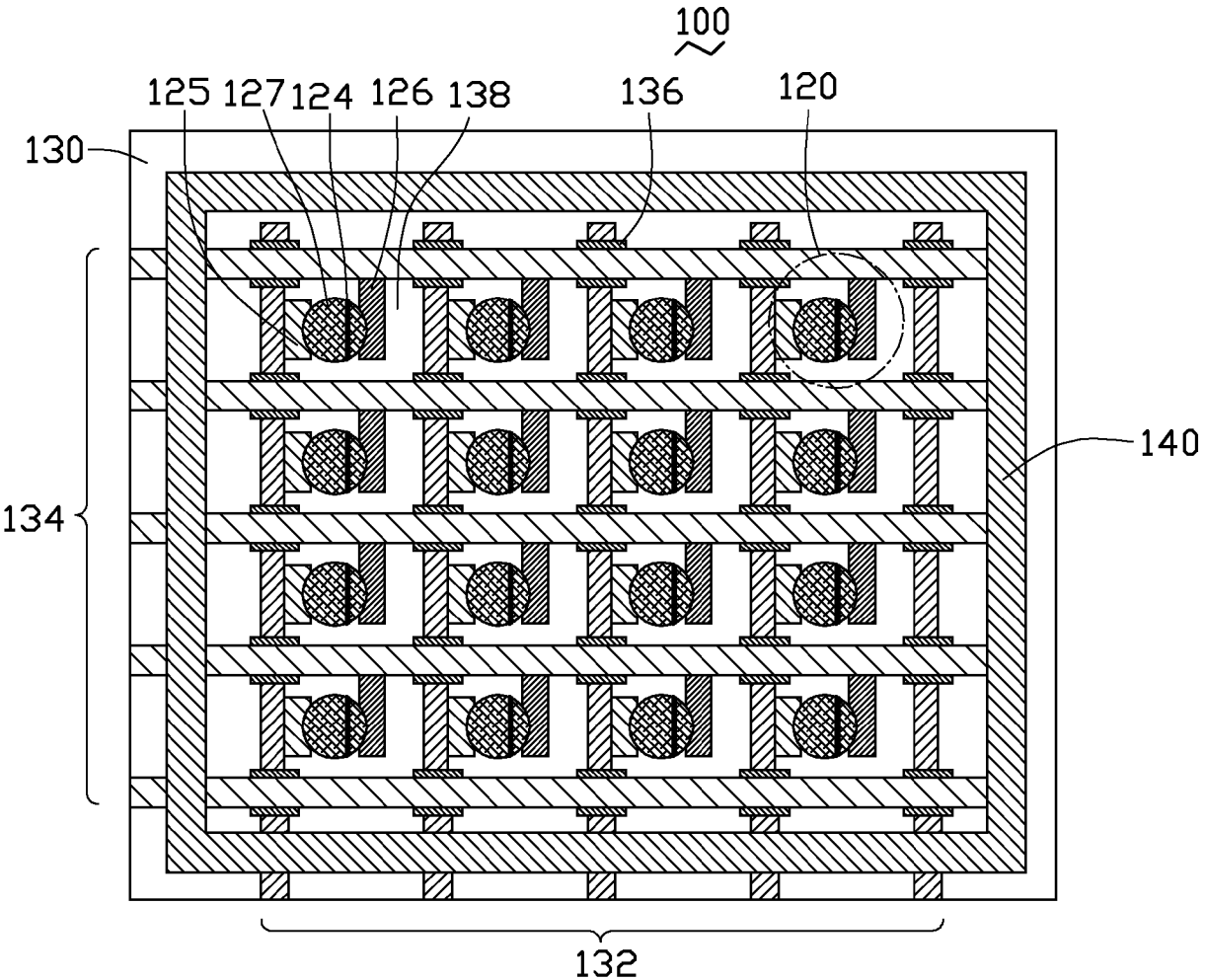
FIG. 5 (RELATED ART)
FIG. 5 is a schematic top view of a conventional surface-conduction electron-emitter display according to the prior art.

Referring to FIG. 4, in this embodiment, a plurality of carbon nanotube wires are arranged in parallel can be chosen to serve as the electron emitters 218 of the pixel unit 220. One end of the carbon nanotube wire is electrically connected to the corresponding second electrode 225, the other end of carbon nanotube wire is pointed in the direction of the first electrode 226 and acts as an electron emission tip 229. The length of the carbon nanotube wire ranges from about 10 to about 1000 microns. A space between the electron emission tip 229 and the corresponding first electrode 226 ranges from about 10 micron to about 500 microns. A space between every two adjacent electron emitters 223 ranges from about 1 nanometer to about 50 nanometers.

The carbon nanotube wire used can be twisted or untwisted. Each twisted carbon nanotube wire can include a plurality of continuously twisted carbon nanotube segments joined end-to-end by van der Waals attractive force. Furthermore, the twisted carbon nanotube wire can include a plurality of carbon nanotubes oriented around an axial direction of the carbon nanotube wire.

Each untwisted carbon nanotube wire includes a plurality of continuously oriented and substantially parallel-arranged carbon nanotube segments joined end-to-end by van der Waals attractive force therebetween. Furthermore, each carbon nanotube segment includes a plurality of substantially parallel-arranged carbon nanotubes, wherein the carbon nanotubes have an approximately same length and are substantially parallel to each other.

The untwisted carbon nanotube wire can be fabricated by the following substeps: (c1) providing an array of carbon nanotubes and a super-aligned array of carbon nanotubes; (c2) pulling out a carbon nanotube structure from the array of carbon nanotubes via a pulling tool (e.g., adhesive tape, pliers, tweezers, or another tool allowing multiple carbon nanotubes to be gripped and pulled simultaneously), the carbon nanotube structure is a carbon nanotube film or a carbon nanotube yarn; (c3) treating the carbon nanotube structure with an organic solvent to form a untwisted carbon nanotube wire.

In step (c3), the carbon nanotube structure is soaked in an organic solvent. During the surface treatment, the carbon nanotube structure is shrunk into a carbon nanotube wire after the organic solvent volatilizing process, due to factors such as surface tension. The surface-area-to-volume ratio and diameter of the treated carbon nanotube wire is reduced. The organic solvent may be a volatilizable organic solvent at room temperature, such as ethanol, methanol, acetone, dichloroethane, chloroform, and any combination thereof.

The carbon nanotubes of the carbon nanotube wire can be selected from a group comprising single-wall carbon nanotubes, double-wall carbon nanotubes, multi-wall carbon nanotubes, and any combination thereof. The diameter of the carbon nanotubes ranges from about 0.5 nanometers (nm) to about 50 nanometers.

Each electron emission tip 229 includes a plurality of arranged carbon nanotubes. The carbon nanotubes are combined with each other by van der Waals attractive force.

The pixel units 220 further include a plurality of fixed elements 221 located on the second electrodes 225. The fixed elements 221 are used for fixing electrode emitters 223 on the second electrodes 225. A material of the fixed element 221 is determined according to user-specific needs. In the present embodiment, the material of the fixed element 221 is the same as that of the second electrodes 225. The fixed elements 221 can be located on the second electrodes 225 by a method of screen-printing.

In operation, a voltage is applied between the first electrode 226 and the second electrode 225, electrons will emit from the electron emitters 223 and strike the phosphor layers 228 on the corresponding first electrodes 226. A space between the electron emission tip 229 and the first electrode 226 approximately ranges from about 10 μm to about 500 μm. The electron emission tips 229 are pointed in the direction of the fist electrode 226, the electrons emitted from the electron emitters 223 uniformly strike the corresponding phosphor layers 228 on the fist electrode 226. All the electrons emitted from the electron emitters 223 strike the phosphor layers 228. Thus the efficiency of irradiance is relatively greatly improved.

It is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field emission display comprising:

a transparent plate;

an insulating substrate spaced from the transparent plate; and one or more grids located on the insulating substrate, wherein each grid comprises:

a first, second, third and fourth electrode down-lead located on a periphery of the grid, the first and the second electrode down-leads being parallel to each other, the third and the fourth electrode down-leads being parallel to each other, wherein the first, second, third and fourth electrode down-leads are insulated from each other; and a pixel unit comprising a first electrode, a second electrode, a phosphor layer and a plurality of electron emitter wires parallel to and spaced from each other, the first electrode being electrically connected to the first electrode down-lead, and the second electrode being electrically connected to the third electrode down-lead, the phosphor layer directly located on the first electrode, one end of each of the plurality of electron emitter wires being electrically connected to the second electrode, an opposite end of each of the plurality of electron emitter wires is directed towards to the first electrode, wherein the phosphor layer is spaced from the transparent plate.

2. The field emission display as claimed in claim 1, wherein the one end of each of the electron emitter wires is located on the second electrode, and the opposite end of each of the electron emitter wires is spaced from the first electrode by a predetermined distance, wherein the predetermined distance is in a range from about 1 micron to about 1 millimeter.

3. The field emission display as claimed in claim 2, wherein the electron emitter wires are spaced from the insulating substrate.

4. The field emission display as claimed in claim 2, further comprising a plurality of fixed elements located on the second electrodes to fix the electron emitter wires.

5. The field emission display as claimed in claim 2, wherein the opposite end of each of the plurality of electron emitter wires points toward the phosphor layer.

6. The field emission display as claimed in claim 1, wherein the electron emitter wires are located on the insulating substrate.

7. The field emission display as claimed in claim 1, wherein a space, between every two adjacent electron emitter wires, ranges from about 1 nanometer to about 100 nanometers.

8. The field emission display as claimed in claim 1, wherein each of the electron emitter wires comprises an electron emission tip spaced from the first electrode in a range from about 1 micron to about 1 millimeter.

9. The field emission display as claimed in claim 1, wherein a length of the electron emitter wires ranges from about 1 micron to about 1 millimeter.

10. The field emission display as claimed in claim 1, wherein each of the electron emitter wires comprises a conductive structure selected from the group consisting of silicon wires, carbon fiber wires and carbon nanotube wires.

11. The field emission display as claimed in claim 10, wherein the carbon nanotube wire is twisted and comprises a plurality of carbon nanotubes oriented around an axial direction of the carbon nanotube wire.

12. The field emission display as claimed in claim 10, wherein a diameter of the plurality of carbon nanotubes range from about 0.5 to about 50 nanometers.

13. The field emission display as claimed in claim 10, wherein a length of the plurality of carbon nanotubes range from about 10 microns to about 1 millimeter.

14. The field emission display as claimed in claim 1, further comprising a plurality of insulators that insulate the first and the second electrode down-leads from the third and the fourth electrode down-leads.

15. The field emission display as claimed in claim 1, wherein a thickness of the phosphor layers ranges from about 5 to about 50 microns.

16. The field emission display as claimed in claim 1, wherein a plurality of grids forms an array, the first electrodes of the pixel units in a row of the grids are electrically connected to the first electrode down-lead, and the second electrodes of the pixel units in a column of the grids are electrically connected to the third electrode down-lead.

17. The field emission display as claimed in claim 1, wherein the insulating substrate comprises a material selected from the group consisting of glass, ceramics, resin, and quartz.

18. A field emission display comprising:

a transparent plate;

an insulating substrate spaced relative to the transparent plate; and at least one grid located on the insulating substrate, wherein each grid comprises:

a first, second, third and fourth electrode down-lead located on a periphery of the at least one grid, the first and the second electrode down-leads being parallel to each other, the third and the fourth electrode down-leads being parallel to each other, wherein the first, second, third and fourth electrode down-leads are insulated from each other; and a pixel unit comprising a first electrode, a second electrode spaced from the first electrode, a phosphor layer, and a plurality of electron emitter wires; wherein the first electrode electrically connects to the first electrode down-lead, the second electrode electrically connects to the third electrode down-lead, the phosphor layer is directly located on the first electrode, one end of each of the plurality of electron emitter wires electrically connects to the second electrode, and an opposite end of each of the plurality of electron emitter wires is spaced from the first electrode; and each of the plurality of electron emitter wires comprises a plurality of carbon nanotubes oriented around an axial direction of the at least one electron emitter wire.

19. The field emission display as claimed in claim 18, wherein the plurality of electron emitter wires are parallel to and spaced from each other.

20. A field emission display comprising:

a transparent plate;

an insulating substrate spaced from the transparent plate; and at least one grid located on the insulating substrate, wherein each grid comprises:

a first, second, third and fourth electrode down-lead located on the periphery of the grid, the first and the second electrode down-leads being parallel to each other, the third and the fourth electrode down-leads being parallel to each other; wherein the first, second, third and fourth electrode down-leads are insulated from each other; and a pixel unit comprising a first electrode, a second electrode, a phosphor layer, at least one electron emitter wire, and a fixed element; wherein the first electrode is spaced from the second electrode, the first electrode electrically connects to the first electrode down-lead, the second electrode electrically connects to the third electrode down-lead, the phosphor layer is directly located on the first electrode, the fixed element is located on the first electrode, one end of the at least one electron emitter wire is held between the fixed element and the second electrode, and an opposite end of the at least one electron emitter wire is spaced from the first electrode; and the at least one electron emitter wire comprises a plurality of carbon nanotubes oriented around an axial direction of the at least one electron emitter wire, wherein the phosphor layer is spaced from the transparent plate.

* * * * *